US010284957B2

(12) United States Patent
Dong

(10) Patent No.: US 10,284,957 B2
(45) Date of Patent: May 7, 2019

(54) DEVICES AND METHODS FOR A HIGH PERFORMANCE ELECTROMAGNETIC SPEAKER BASED ON MONOLAYERS

(71) Applicant: Google LLC, Mountain View, CA (US)

(72) Inventor: Jianchun Dong, Palo Alto, CA (US)

(73) Assignee: Google LLC, Mountain View, CA (US)

( * ) Notice: Subject to any disclaimer, the term of this patent is extended or adjusted under 35 U.S.C. 154(b) by 183 days.

(21) Appl. No.: 15/147,582

(22) Filed: May 5, 2016

(65) Prior Publication Data

US 2017/0026753 A1 Jan. 26, 2017

Related U.S. Application Data

(60) Provisional application No. 62/195,547, filed on Jul. 22, 2015.

(51) Int. Cl.

| | |
|---|---|
| ***H04R 25/00*** | (2006.01) |
| ***H04R 7/10*** | (2006.01) |
| ***H04R 3/08*** | (2006.01) |
| ***H04R 9/06*** | (2006.01) |
| ***H04R 9/04*** | (2006.01) |
| ***H04R 31/00*** | (2006.01) |

(52) U.S. Cl.

CPC ..... *H04R 7/10* (2013.01); *H04R 3/08* (2013.01); *H04R 9/047* (2013.01); *H04R 9/06* (2013.01); *H04R 31/003* (2013.01); *H04R 2307/023* (2013.01); *H04R 2307/025* (2013.01); *H04R 2420/07* (2013.01); *H04R 2499/11* (2013.01)

(58) Field of Classification Search

CPC ..... H04R 1/04; H04R 19/016; H04R 1/06; H04R 1/08; H04R 7/08; H04R 7/10

USPC ..... 381/174, 176, 399, 401, 430, 409, 410

See application file for complete search history.

(56) References Cited

U.S. PATENT DOCUMENTS

| | | | |
|---|---|---|---|
| 2007/0009133 | A1 | 1/2007 | Gerkinsmeyer |
| 2009/0074228 | A1 | 3/2009 | Mango et al. |
| 2011/0242932 | A1 | 10/2011 | Lebental et al. |

(Continued)

FOREIGN PATENT DOCUMENTS

| | | | |
|---|---|---|---|
| KR | 10-2014-0116355 | A | 10/2014 |
| WO | 2014100012 | A1 | 6/2014 |

OTHER PUBLICATIONS

International Search Report and Written Opinion of corresponding International Application No. PCT/US2016/041764 (dated Oct. 19, 2016).

*Primary Examiner* — Phylesha Dabney

(74) *Attorney, Agent, or Firm* — McDonnell Boehnen Hulbert & Berghoff LLP

(57) ABSTRACT

A device is provided that comprises a membrane that includes one or more layers of an electrically resistive material. The device also comprises a film disposed along a surface of the membrane to form a coil. The film includes one or more layers of an electrically conductive material. The device also comprises a support structure coupled to a periphery of the membrane. The device also comprises a magnet arranged to provide a magnetic field that is substantially parallel to the surface of the membrane. The device also comprises a signal conditioner configured to provide an electrical signal to the coil to generate an electrical current flowing through the coil. The electrical current interacts with the magnetic field to cause a vibration of the membrane. Characteristics of the vibration are based on at least the electrical signal provided by the signal conditioner.

18 Claims, 6 Drawing Sheets

(56) References Cited

U.S. PATENT DOCUMENTS

| | | | |
|---|---|---|---|
| 2014/0112504 | A1 | 4/2014 | Waale |
| 2014/0207467 | A1 | 7/2014 | White et al. |
| 2014/0247954 | A1 | 9/2014 | Hall et al. |
| 2015/0109534 | A1 | 4/2015 | Norris et al. |

DEVICES AND METHODS FOR A HIGH PERFORMANCE ELECTROMAGNETIC SPEAKER BASED ON MONOLAYERS

CROSS-REFERENCE TO RELATED APPLICATION

This application claims priority to U.S. Provisional Patent Application Ser. No. 62/195,547, filed on Jul. 22, 2015, the entirety of which is incorporated herein by reference.

BACKGROUND

Unless otherwise indicated herein, the materials described in this section are not prior art to the claims in this application and are not admitted to be prior art by inclusion in this section.

A speaker is an electroacoustic transducer that converts an electrical signal into a corresponding sound. For human audibility, an ideal speaker or earphone should generate a constant sound pressure level from 20 Hz to 20 kHz. In other words, the ideal speaker should have a flat frequency response within the audible frequency range. Electromagnetic speakers, such as dynamic loudspeakers, typically include a diaphragm that is driven by a magnetic coil. Because the coil moves together with the diaphragm, the large total effective moving mass as well as the mechanical properties of the diaphragm and diaphragm suspension can cause poor high frequency response. This non-flat frequency response, along with negative effects of potential/kinetic energy stored by the large mass (e.g., the diaphragm may not start or stop motion immediately in response to the input electrical signal), can reduce the quality of the sound produced by the speaker.

SUMMARY

In one example, a speaker apparatus is provided that includes a diaphragm and a voice coil that drives the diaphragm. The diaphragm includes an electrically resistive molecular multilayer, such as a Boron-Nitride (BN) sheet, that has a tensile strength sufficient to support the voice coil. The voice coil includes an electrically conductive monolayer, such as graphene, that is patterned on a surface of the diaphragm. A monolayer is a single, closely-packed layer of atoms, molecules, or cells. Thus, the speaker apparatus provides a lightweight diaphragm that has a high fidelity for audio reproduction and an improved high-frequency response to input electrical signals.

In another example, a device is provided comprising a membrane that includes one or more layers of an electrically resistive material. The device also includes a film disposed along a surface of the membrane to form a coil. The film includes one or more layers of an electrically conductive material. The device also includes a support structure coupled to a periphery of the membrane. The device also includes a magnet arranged to provide a magnetic field that is substantially parallel to the surface of the membrane. The device also includes a signal conditioner to provide an electrical signal to the coil to generate an electrical current flowing through the coil. The electrical current interacts with the magnetic field to cause a vibration of the membrane. Characteristics of the vibration are based on at least the electrical signal provided by the signal conditioner.

In yet another example, a method is provided that involves depositing a film along a surface of a membrane to form a coil. The membrane includes one or more layers of an electrically resistive material. The film includes one or more layers of an electrically conductive material. The method also involves coupling a periphery of the membrane to a support structure. The method also involves arranging a magnet to provide a magnetic field that is substantially parallel to the surface of the membrane. The method also involves electrically coupling a signal conditioner to the film. The signal conditioner is configured to provide an electrical signal to the coil to generate an electrical current flowing through the coil. The electrical current interacts with the magnetic field to cause a vibration of the membrane. Characteristics of the vibration are based on at least the electrical signal provided by the signal conditioner.

In still another example, an electromagnetic speaker device is provided. The device comprises a diaphragm that includes a monolayer of an electrically resistive material. The device also comprises a voice coil that includes a monolayer of an electrically conductive material that is patterned along along a surface of the diaphragm. The device also comprises a magnet arranged to provide a magnetic field that is substantially parallel to the surface of the diaphragm. The device also comprises a signal conditioner to provide an electrical signal to the voice coil to generate an electrical current flowing through the voice coil. The electrical current interacts with the magnetic field to cause a vibration of the diaphragm. Characteristics of the vibration are based on at least the electrical signal provided by the signal conditioner.

In still another example, a system is provided that includes means for depositing a film along a surface of a membrane to form a coil. The membrane includes one or more layers of an electrically resistive material. The film includes one or more layers of an electrically conductive material. The system also includes means for coupling a periphery of the membrane to a support structure. The system also includes means for arranging a magnet to provide a magnetic field that is substantially parallel to the surface of the membrane. The system also includes means for electrically coupling a signal conditioner to the film. The signal conditioner is configured to provide an electrical signal to the coil to generate an electrical current flowing through the coil. The electrical current interacts with the magnetic field to cause a vibration of the membrane. Characteristics of the vibration are based on at least the electrical signal provided by the signal conditioner.

These as well as other aspects, advantages, and alternatives, will become apparent to those of ordinary skill in the art by reading the following detailed description, with reference where appropriate to the accompanying figures.

DETAILED DESCRIPTION

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations.

I. Overview

One example embodiment may involve a speaker that uses a boron-nitride (BN) sheet as a diaphragm (or membrane) and graphene patterned on a surface of the BN sheet as a coil, instead of a typical magnetic voice coil and diaphragm arrangement. In this embodiment, the lattice structure of the BN sheet can provide enough tensile strength to support the graphene film while maintaining a very light weight. The graphene's electrical conduction properties may allow the graphene film to act as a voice coil, and the BN sheet's electrical resistivity properties may prevent or reduce interference with the graphene's electrical signal. Thus, in such an embodiment, the graphene pattern formed on the BN sheet may provide a lightweight speaker, which has a high fidelity for audio reproduction (e.g., by providing improved high frequency response such that a substantially flat frequency response can be achieved for the audible frequency range).

In some implementations described herein, a lightweight graphene-BN speaker may have a flat or nearly flat frequency response across frequencies that are outside the audible frequency range (e.g., ultrasound frequencies, etc.) as well as frequencies within the audible frequency range. In one example, an ultrasound sensor that has such flat frequency response may therefore also have an improved accuracy or reliability. Further, in some embodiments herein, other molecular sheets or nanomaterials are utilized to form the very light weight speaker that provides high fidelity sounds.

II. Illustrative Speaker Configurations

Figure 1:
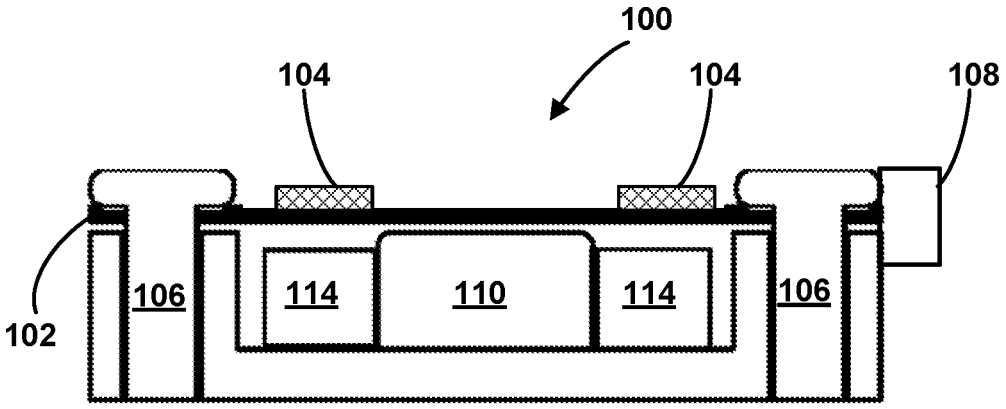
FIG. 1 is a simplified block diagram illustrating a cross-section view of an electromagnetic speaker device, according to an example embodiment.

FIG. 1 is a simplified block diagram illustrating a cross-section view of an electromagnetic speaker device 100, according to an example embodiment. In particular, FIG. 1 shows an electromagnetic transducer 100 with a membrane 102 (e.g., diaphragm) configured to vibrate in response to an electrical signal applied to a film 104 (e.g., coil). As shown, the device 100 includes the membrane 102, the film 104, a support structure 106, a magnet 108, a signal conditioner 110, and a wire coil 114.

The membrane 102 (e.g., diaphragm) is configured as a diaphragm that vibrates to affect pressure of surrounding air and therefore produce a sound. The membrane 102 is formed from one or more layers of an electrically resistive material. In some embodiments, a layer of the electrically resistive material of the membrane 102 is formed from a crystalline structure (e.g., molecular lattice) that provides suitable strength characteristics for supporting the film 104 even while having a small thickness (e.g., less than 1 micrometer). In one example, the membrane 102 is formed from a boron-nitride (BN) sheet or any other crystalline molecular structure that is electrically resistive. For instance, a BN molecular multilayer sheet may only have a thickness of about 10 nm, while having a strength equivalent to a steel sheet having a thickness that is one hundred times, two hundred times, or more than the BN sheet and several hundred times more massive as well. Other thicknesses of the membrane 102 are possible as well (e.g., less than 50 nm, etc.).

In some examples, the one or more layers of the electrically resistive material of the membrane 102 may have any crystalline form such as a hexagonal structure (e.g., hexagonal BN), a cubic structure (e.g., sphalerite structure, cubic BN, etc.), a wurtzite structure (e.g., wurtzite BN), a nanotube structure (e.g., BN nanotube), or a fullerene structure among other possibilities. Further, in some examples, the membrane 102 may be formed from a single layer of the electrically resistive material. In other examples, the membrane 102 may be formed from multiple layers of the electrically resistive material.

Various fabrication processes are possible to synthesize the membrane 102, such as chemical vapor deposition, etching, intercalation, etc. In one example, the membrane 102 has a substantially round shape. For instance, a large BN sheet can be processed by laser cutting round portions of the sheet to form membranes such as the membrane 102. However, other shapes for the membrane 102 and methods for synthesizing the membrane 102 are possible as well.

The film 104 is patterned along a surface of the membrane 102 and shaped like a voice coil. Although FIG. 1 shows the film 104 disposed along the surface of the membrane 102 opposite to the signal conditioner 110, in some examples, the film 104 may be disposed along any other surface of the membrane 102 (e.g., opposite surface, etc.). The film 104 is formed from one or more layers of an electrically conductive material. Similarly to the membrane 102, in some embodiments, a layer of the electrically conductive material of the film 104 is formed from a crystalline structure (e.g., molecular lattice) that provides suitable strength characteristics for withstanding deformations due to vibration of the membrane 102 even while having a small thickness (e.g., less than 1 micrometer) and a light weight. However, unlike the membrane 102, the film 104 is formed from an electrically conductive material that can carry an electrical current to function as a voice coil. In one example, the film 104 is formed from a graphene sheet or any other crystalline molecular structure that is electrically conductive. For instance, a graphene monolayer sheet may only have a thickness of about 10 nm, while having electrical conductivity and strength characteristics that are similar or superior to a metallic conductor that has a much higher thickness and weight.

In some examples, similarly to the membrane 102, the one or more layers of the film 104 may have various crystalline forms (e.g., hexagonal lattice, cubic, etc.), and may also be fabricated similarly. Further, in some examples, the film 104 may be formed from a single layer of the electrically conductive material. In other examples, the film 104 may be formed from multiple layers of the electrically conductive material.

Additionally, in some examples, the film 104 may be synthesized using similar fabrication processes to those of the membrane 102. In one example, a graphene sheet may be deposited onto the membrane 102 by chemical vapor deposition, and then shaped as a voice coil by chemical etching among other possibilities. In another example, a BN sheet and a graphene sheet may be formed together by intercalation, and then the graphene sheet may be etched to the shape of a voice coil. Other fabrication processes are possible as well.

The support structure 106 may be made of a material that allows some motion of the membrane 102. The membrane 102 (i.e., diaphragm) may be held in place by the support structure 106. The support structure 106 may include any material suitable to couple to a periphery of the membrane 102 and support the membrane 102 as the membrane 102 vibrates. For example, the support structure 106 may be made of rubber, plastic, or springs among other possibilities. By allowing some movement of the membrane 102, vibrations may more easily be conducted by membrane 102.

The magnet 108 may include any magnet that is arranged to provide a magnetic field that is substantially parallel to the surface of the membrane 102. For example, the magnet 108 may include a permanent magnet that is coupled to a side of the membrane 102 as shown in FIG. 1. However, in some instances, the magnet 108 may take any other form. In one instance, the magnet 108 may be implemented to have a north pole that is positioned along one side of the membrane 102 and a south pole that is positioned at an opposite side of the membrane 102. In another instance, the magnet 108 may be implemented as an electromagnet that is controlled to modify the first magnetic field (e.g., intensity, direction, etc.). Other implementations of the magnet 108 are possible as well.

The signal conditioner 110 may include one or more electrical components (e.g., processors, resistors, capacitors, etc.) configured to provide an electrical signal to the film 104. In an example scenario, an electrical signal representing an audio signal is fed through the film 104.

In one implementation, the magnetic field provided by magnet 108 induces Lorentz forces on electrical charges of the audio signal flowing through film 104. Further, for example, the electrical signal may correspond to an alternating current (AC), and thus the Lorentz forces may responsively have alternating directions over time. Additional, the Lorentz forces may vary proportionally to the audio signal (and the associated alternating current) flowing through film 104. Thus, the Lorentz forces interact with film 104 to cause a vibration of membrane 102 coupled to film 104. In this implementation, characteristics of the vibration are at least based on the electrical signal provided by the electrical signal provided by the signal conditioner 110. For instance, the amplitude and/or frequency of the vibration may be adjusted by modifying the first magnetic field of magnet 108, the amplitude of the audio signal, and/or the frequency of the audio signal among other possibilities.

In another implementation, the audio signal in the film 104 induces a second magnetic field that is time-varying. In this implementation, the induced second magnetic field varies proportionally to the audio signal applied to the film 104. The first magnetic field of the magnet 108 interacts with the second magnetic field of the film 104 to cause a vibration of the membrane 102. Characteristics of the vibration are based on the electrical signal provided by the signal conditioner 110. For instance, by modifying the first magnetic field of the magnet 108, the amplitude of the vibrations may be increased or decreased. Thus, in some examples, the signal conditioner 110 is configured to adjust the first magnetic field of the magnet 108. Further, for instance, by modifying the electrical signal in the film 104, the frequency of the vibrations may be responsively modified. Thus, through this process the device 100 may produce an audio sound that corresponds to the audio signal (i.e., electrical signal) provided by the signal conditioner 110.

In some examples, the characteristics of the vibration are also based on mechanical characteristics of the diaphragm (i.e., membrane 102) and/or mechanical characteristics of the support structure 106. For instance, Lorentz forces suitable for causing a particular amplitude/frequency of vibration may depend on the mass of membrane 102. Thus, in this instance, a light-weight diaphragm may be suitable for a low-power audio signal (e.g., electrical signal provided by signal conditioner 110). Whereas, for instance, another membrane/diaphragm having a greater mass may be suitable for a relatively higher power audio signal.

Various embodiments herein are possible for the signal conditioner 110 to provide the electrical signal to the film 104. In one embodiment, the device 100 may include one or more leads (not shown) configured to electrically couple the signal conditioner 110 to the film 104. By way of example, the one or more leads may be formed from an electrically conductive material similar or same (e.g., graphene) as the electrically conductive material of the film 104. In this example, the one or more leads may be patterned similarly to the film 104 along the surface of the membrane 102 to couple the film 104 to the periphery of the membrane 102 where the support structure 106 is coupled to the membrane 102. Further, in this example, the signal conditioner may be configured to electrically couple with the one or more leads at the periphery of the membrane.

In another embodiment, the signal conditioner 110 may be configured to provide the electrical signal to the film 104 via inductive (or capacitive) coupling. For example, the wire coil 114 may be energized by the signal conditioner 110. As shown, the wire coil 114 may be arranged proximal to the film 104 and formed from a conductor (e.g., copper, etc.) capable of carrying an electrical current provided by the signal conditioner 110. In turn, the electrical signal can be induced in the film 104 as the electrical current in the wire coil 114 varies.

In yet another embodiment, the signal conditioner 110 may be configured to provide the electrical signal to the film 104 via radiative electromagnetic transmission. By way of example, the signal conditioner 110 may include components (not shown) for adjusting the resonance frequency of the film 104 (e.g., coil), and a radiation source (not shown) may provide radiation to the film 104 such that the film 104 (e.g., coil) may conduct the electrical signal according to the resonance frequency that is adjusted by the signal conditioner 110. Other examples are possible as well.

In some embodiments, the device 100 may include additional or fewer components than those shown in FIG. 1. For example, the device 100 may include one or more leads to electrically couple the signal conditioner 110 with the film 104 instead of the wire coil 114 shown in FIG. 1.

Further, it is noted that sizes of the various components of the device 100 illustrated in FIG. 1 are not necessarily to scale but are illustrated as shown for convenience in description. For example, the relative sizes of the membrane 102, the film 104, and the support structure 106 may be different than the sizes shown in FIG. 1.

Further, in some embodiments, the various components of the device 100 may have different arrangements and/or shapes than those shown in FIG. 1. As an example, the signal conditioner 110 may be alternatively placed in a remote device that is communicatively coupled with the film 104. As another example, the magnet 108 may be alternatively arranged or located in a different position to provide the first magnetic field. Other examples are possible as well.

In line with the discussion above, the light weight of the membrane 102 and the film 104 may allow the signal conditioner 110 to control the device 100 to produce sound with a substantially flat frequency response by modifying the electrical signal in the film 104 and/or the magnetic properties of the magnet 108. Further, the structure of the film 104 may allow the device 100 to produce the desired sound with a small voltage (less than 10 Volts) characteristic of electromagnetic speakers rather than the high voltage (e.g., 100 Volts) characteristic of electrostatic speakers. Thus, the device 100 may be more suitable for applications that involve miniature speakers (e.g., earphones, hand-held devices, etc.) than electrostatic speakers that require a higher voltage input. However, in some embodiments, the device 100 may be adapted for any type of voltage input and/or electrical signal.

Figure 2A:
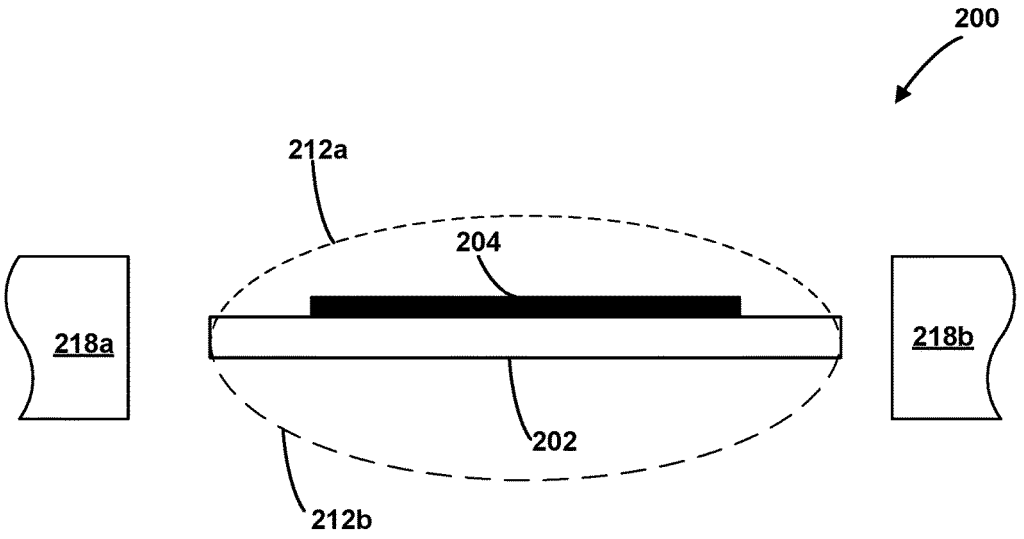
FIG. 2A illustrates a side-view of another electromagnetic speaker device, according to an example embodiment.

FIG. 2A illustrates a side-view of another electromagnetic speaker device 200, according to an example embodiment. The device 200 may be similar to the device 100. For example, the device 200 includes a membrane 202 (e.g., diaphragm) and a film 204 (e.g., voice coil) that are similar, respectively, to the membrane 102 and the film 104 of the device 100.

As shown, a magnet having two poles 218*a* and 218*b* is arranged to provide a first magnetic field (e.g., from the pole 218*a* to the pole 218*b*) having a direction that is substantially parallel to a surface of the membrane 202 where the film 204 is patterned. It is noted that the magnet(s) 218*a*-218*b* can have any other shape or arrangement than that shown. In one example, the magnet 218*a*-218*b* can be alternatively implemented as two separate magnets that are arranged such that a north pole of one magnet corresponds to the pole 218*a* and the south pole of another magnet corresponds to pole 218*b*. In another example, the magnet 218*a*-218*b* can be alternatively implemented as a coil (not shown) that is arranged to surround the membrane 202. Other implementations of the magnet(s) 218*a*-218*b* are possible as well to provide the first magnetic field that is, at least in part, substantially parallel to the surface of the membrane 202.

Further, a varying electrical signal in the film 204 may induce a second magnetic field. In an example scenario, the first magnetic field induced by the magnet(s) 218*a*-218*b* and the second magnetic field induced by the film 204 (e.g., coil) interact to cause the membrane 202 to vibrate. Characteristics of the vibration are based on the electrical signal in the film 204 (that causes the second magnetic field). In an example scenario, a particular electrical signal in the film 204 may cause the membrane 202 to vibrate between dashed lines 212*a* and 212*b* shown in FIG. 2A. Thus, the device 200 may control the characteristics of the vibration in line with the discussion above by modifying the first and/or second magnetic fields.

Further, due to the light weight of the membrane 202 and the film 204, a substantially flat frequency response is achieved. For example, if the frequency of the electrical signal in the film 204 is modified, the vibrations of the membrane 202 are responsively modified according to the frequency quicker than a corresponding change to a traditional speaker that includes a more massive diaphragm/coil that have more kinetic energy stored therein.

Figure 2B:
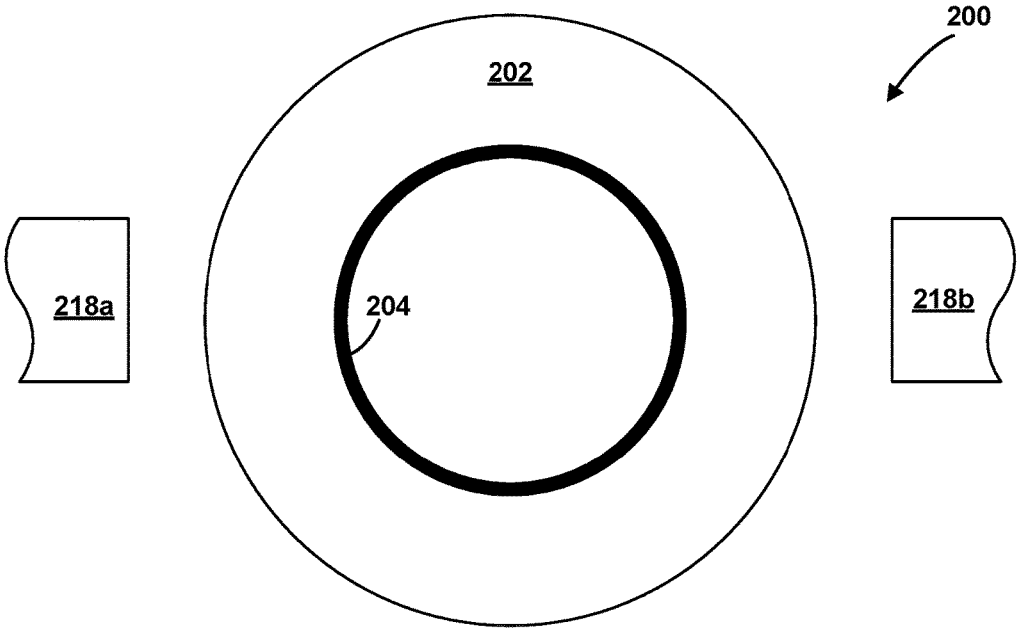
FIG. 2B illustrates a top/down view of the device of FIG. 2A.

In one example embodiment, the membrane 202 may have the round shape shown in FIGS. 2A-2B with a diameter of two centimeters and a thickness of five nanometers. In this example, the membrane 202 and the coil 204 may have a lightweight of less than five micrograms. However, in other embodiments, the membrane 202 may have any other shape, diameter, or thickness, and in turn, a different weight. In any case, the weight of the membrane 202 and the film 204 is much lower than a typical diaphragm/magnetic coil arrangement. In turn, for example, the device 200 may provide a high fidelity audio reproduction (e.g., substantially flat frequency response, etc.) for the electrical signal provided to the film 204.

FIG. 2B illustrates a top/down view of the device 200 of FIG. 2A. The view shown in FIG. 2B corresponds to a view where the surface of the membrane 202 that includes the film 204 is pointing out of the page. In some examples, the membrane 202 may be formed from a BN monolayer sheet and the film 204 may be formed as graphene that is patterned onto the surface of the BN monolayer sheet. Other implementations are possible as well in line with the discussion above.

As shown in FIG. 2B, the film 204 is patterned onto the surface of the membrane 202 and shaped as a single loop of a voice coil. However, in some embodiments, the film 204 may be alternatively implemented as multiple loops. Further, as shown, the film 204 is implemented as a closed loop. Thus, for example, the coil 204 may receive the electrical signal via inductive coupling, capacitive coupling, radiative EM transmission, etc., in line with the discussion above. However, in some embodiments, the film 204 may be alternatively implemented as an open loop that is coupled to leads for receiving the electrical signal.

Figure 3:
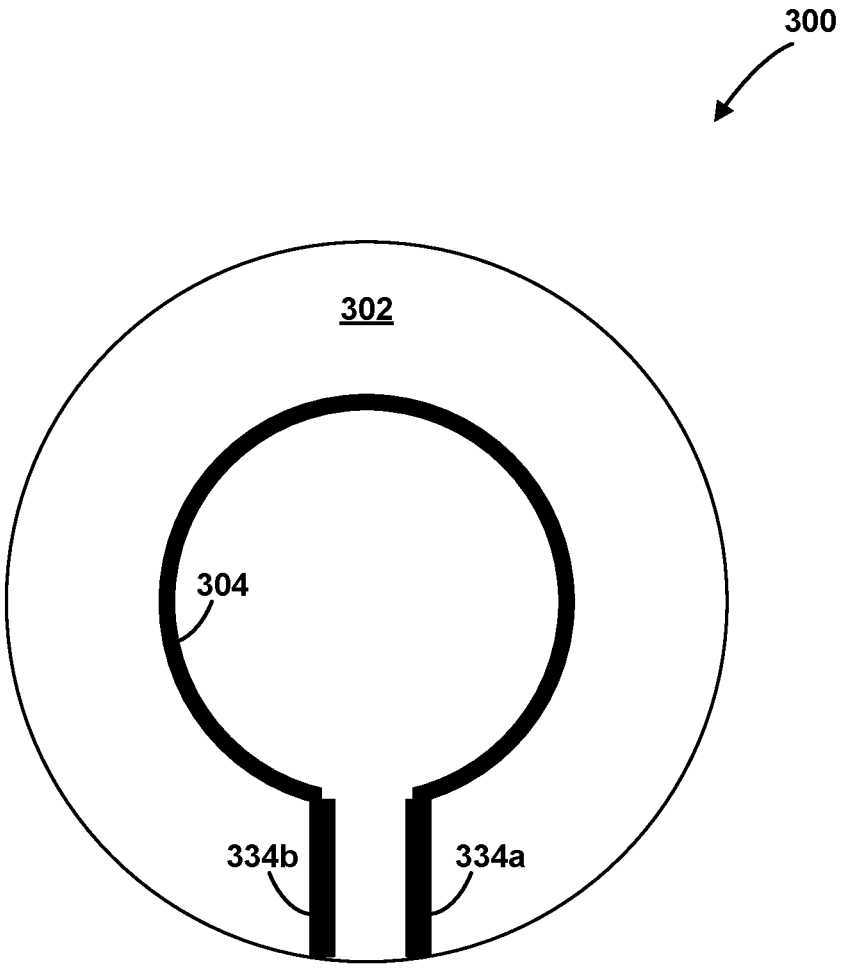
FIG. 3 illustrates yet another electromagnetic speaker device, according to an example embodiment.

For example, FIG. 3 illustrates yet another electromagnetic speaker device 300, according to an example embodiment. The device 300 may be similar to the devices 100 and 200. For example, the device 300 includes a membrane 302 that is similar to the membranes 102 and 202. Further, the device 300 includes a film 304 that is similar to the films 104 and 204.

However, unlike the film 204, the film 304 is implemented as an open loop. Further, as shown, the device 300 includes leads 334*a*-334*b* that are configured to electrically couple the film 304 to a periphery of the membrane 302.

In some examples, the leads 334*a*-334*b* may be formed from a same or similar material as the film 304 and may also be patterned onto the surface of the membrane 302 in a similar manner. Referring back to FIG. 1 by way of example, the leads 334*a*-334*b* may allow the signal conditioner 110 to electrically couple with the film 304 at the periphery of the membrane 302. In other examples, the leads 334*a*-334*b* may be formed from any other conductive material (e.g., metallic conductor, etc.), and/or may not be patterned onto the surface of the membrane 302.

III. Illustrative Methods

Figure 4:
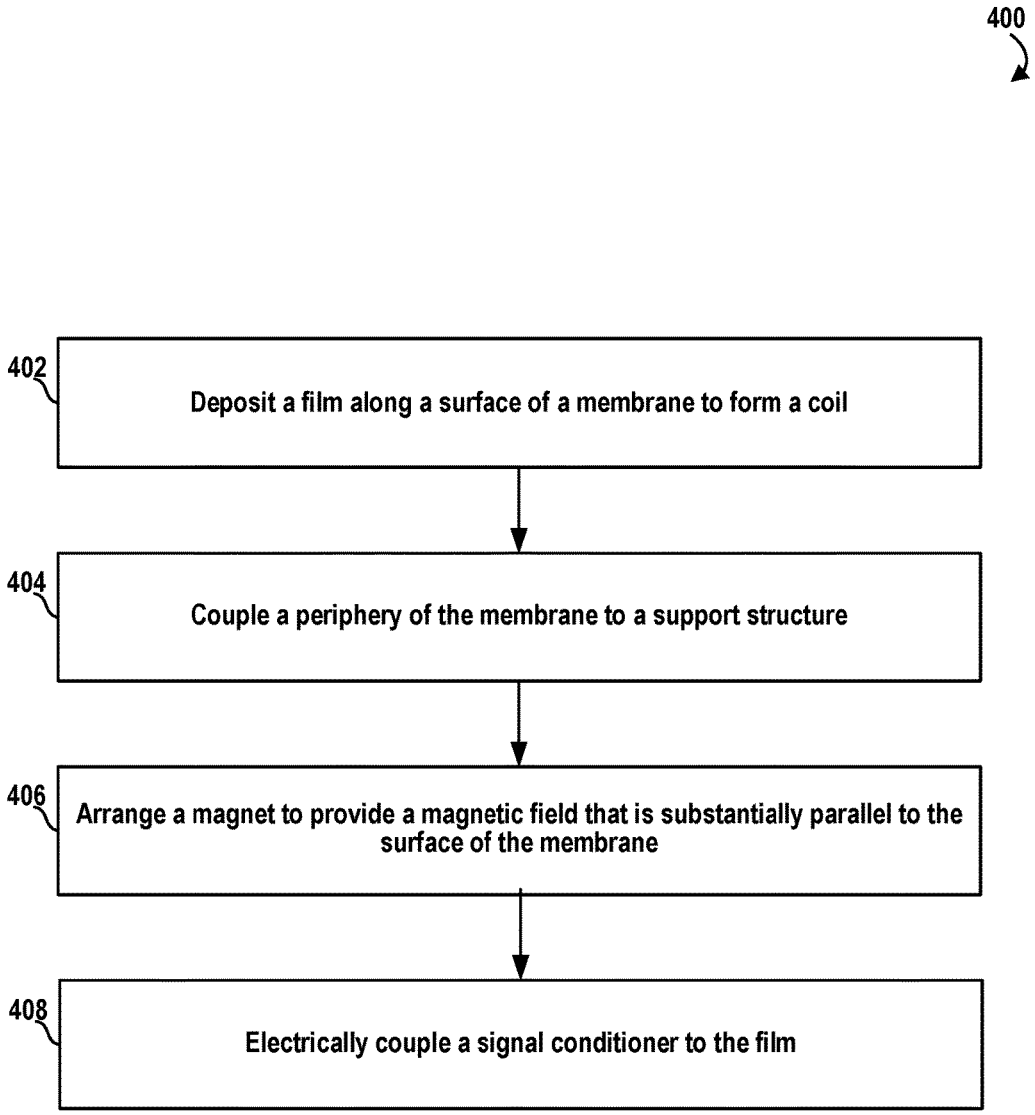
FIG. 4 is a block diagram of a method, according to an example embodiment.

FIG. 4 is a block diagram of a method 400, according to an example embodiment. Method 400 shown in FIG. 4 presents an embodiment of a method that could be used with the devices 100, 200, and/or 300, for example. Method 400 may include one or more operations, functions, or actions as illustrated by one or more of blocks 402-408. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

In addition, for the method 400 and other processes and methods disclosed herein, the flowchart shows functionality and operation of one possible implementation of present embodiments. In this regard, each block may represent a module, a segment, a portion of a manufacturing or operation process, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

In some examples, for the method 400 and other processes and methods disclosed herein, each block may represent circuitry that is wired to perform the specific logical functions in the process.

In some examples, the method 400 may be a method of manufacture for synthesizing at least part of an electromagnetic speaker such as the speakers 100, 200, and 300. In other examples, the method 400 may include a method for operating a speaker, and/or any other function described in the present disclosure.

At block 402, the method 400 involves depositing a film along a surface of a membrane to form a coil. The membrane includes one or more layers of an electrically resistive material. The film includes one or more layers of an electrically conductive material. For example, the film may be deposited via various nano-fabrication processes such as chemical vapor deposition, etching, or intercalation in line with the discussion above. Accordingly, in some examples, the method 400 also involves depositing the film on the surface of the membrane based on chemical vapor deposition.

At block 404, the method 400 involves coupling a periphery of the membrane to a support structure. For example, the membrane may be shaped according to a particular speaker application (e.g., round, rectangular, etc.), and a robotic arm or other component of a device that performs the method 400 may place the membrane onto the support structure. The support structure may be similar to the support structure 106 of FIG. 1. Thus, for example, the support structure may keep the membrane in place, while allowing the membrane to vibrate.

Accordingly, in some examples, the method 400 may also involve cutting a substantially circular portion of a sheet of the electrically resistive material to form the membrane. For example, a process such as laser etching may be utilized to define the periphery of the membrane to have a round shape or any other shape.

At block 406, the method 400 involves arranging a magnet to provide a magnetic field that is substantially parallel to the surface of the membrane. In some examples, the magnet may be a permanent magnet arranged to provide the first magnetic field. In other examples, the magnet may be an electromagnet that is configured to receive control signals to modify the first magnetic field. The magnetic field may be substantially parallel to the surface of the membrane.

At block 408, the method 400 involves electrically coupling a signal conditioner to the film. The signal conditioner is configured to provide an electrical signal to the film to generate an electrical current flowing through the coil. The electrical current interacts with the magnetic field to cause a vibration of the membrane. Characteristics of the vibration are based on at least the electrical signal provided by the signal conditioner.

By way of example, the electrical signal may be an alternating current (AC) signal that has a particular frequency provided to the film that is shaped as a coil. In turn, the magnetic field may exert a Lorentz force on the coil (i.e., the film) that varies periodically according to the frequency of the AC signal. Thus, the varying Lorentz force may cause the film and the membrane coupled to the film to vibrate according to particular characteristics in line with the discussion above. Due to the lightweight of the membrane and the film, the vibration may have a substantially flat frequency response that corresponds to the frequency of the AC signal.

In some examples, the signal conditioner may provide another electrical signal. The other electrical signal may be for receipt by the magnet. In these examples, the signal conditioner may modify the other electrical signal to adjust the magnetic field of the magnet. Further, in these examples, characteristics of the vibration of the membrane are based also on the other electrical signal. Referring back to FIG. 2A by way of example, the computing device of the method 500 may adjust the magnetic field caused by the magnet(s) 218*a*-218*b* to adjust the amplitude of the vibration of the membrane 202 in addition to the frequency of the vibration that is based on the electrical signal provided to the film 204.

Various implementations for electrically coupling the signal conditioner of the block 408 are possible. In one example, metallic contacts may be physically coupled as leads to the film. In another example, the leads may be patterned along the surface of the membrane similarly to the leads 334*a*-*b* of the device 300. In yet another example, the signal conditioner may provide the electrical signal to the film via inductive (or capacitive) coupling in line with the description of the wire coil 114 of the device 100. In still another example, the signal conditioner may electrically couple with the film via radiative electromagnetic energy transmission among other possibilities.

Accordingly, in some examples, the method 400 may also involve depositing another film on the surface of the membrane to form one or more leads. The one or more leads are formed from the same (or a similar) electrically conductive material as the film of the coil. The one or more leads are disposed along the surface of the membrane to couple the film of the coil to the periphery of the membrane (e.g., similarly to the leads 334*a*-334*b* shown in FIG. 3). In these examples, the signal conditioner is configured to electrically couple with the one or more leads at the periphery of the membrane.

IV. Illustrative Computing Devices and Computer Readable Media

Systems and devices in which example embodiments may be implemented will now be described in greater detail. In general, an example system may be implemented in or may take the form of a wearable computer. However, an example system may also be implemented in or take the form of other devices, such as a mobile phone, among others. Further, an example system may take the form of non-transitory computer readable medium, which has program instructions stored thereon that are executable by at a processor to provide the functionality described herein. An example, system may also take the form of a device such as a wearable computer or mobile phone, or a subsystem of such a device, which includes such a non-transitory computer readable medium having such program instructions stored thereon.

One example embodiment may be implemented in a wearable computer having a head-mounted device (HMD), or more generally, may be implemented on any type of device having a glasses-like form factor. In other embodiments, the HIVID may be similar to glasses, but without having lenses. Further, an example embodiment involves an ear-piece with a monolayer-based electromagnetic transducer (e.g., speaker). The ear-piece is attached to a glasses-style support structure, such that when the support structure is worn, the ear-piece is close to a wearer's ear. For instance, the ear-piece may be located on the hook-like section of a side arm, which extends behind a wearer's ear and helps keep the glasses in place. Accordingly, the ear-piece may extend from the side arm to the back of the wearer's ear at the auricle, for instance. In some additional embodiments, the ear-piece may be located on the side arm itself, or anywhere along the frame of the glasses-style support structure.

In some example implementations of the HMD, the ear-piece may be spring-loaded so that the electromagnetic speaker fits comfortably and securely against the back of the wearer's ear. For instance, the ear-piece may include an extendable member, which is connected to the glasses on one end and is connected to the electromagnetic transducer on the other end. A spring mechanism may accordingly serve to hold the end of the member having the electromagnetic speaker away from side-arm when the glasses are not being worn. In other embodiments, the ear-piece may be located on the stem of the glasses-style support near the wearer's ear. Various placements of the ear piece may be used with the methods and apparatuses disclosed herein.

In another example embodiment, the speaker may be implemented in a non-wearable computing device. Example devices include wireless audio systems, loudspeakers, car audio systems, home audio systems, televisions, or any other device (wearable or non-wearable) that provides or controls an electrical signal representative of an audio output to be generated by the speaker.

Figure 5:
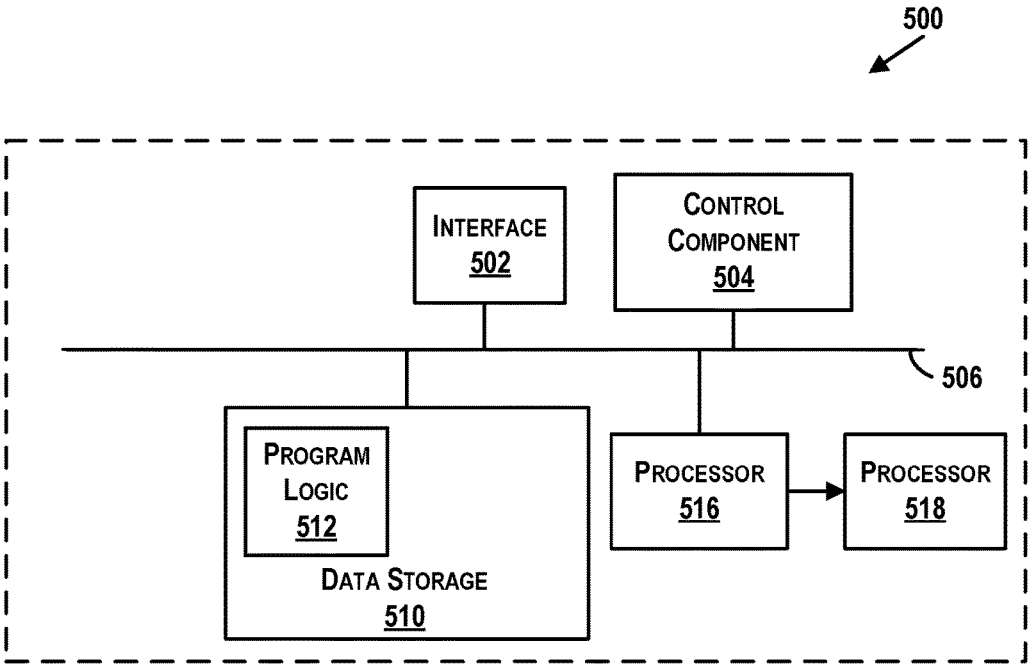
FIG. 5 is a block diagram of a computing device, according to an example embodiment.

FIG. 5 is a block diagram of a computing device 500, according to an example embodiment. The computing device 500 may be configured to operate at least some components of the methods, systems, devices, and/or apparatuses illustrated in FIGS. 1-4. In one example, the computing device 500 may correspond to a nano-fabrication platform to operate components such as a robotic arm, etc., to manufacture and/or synthesize a speaker such as the speakers 100-300 in line with the description of the method 400. In another example, the device 500 may be configured to operate any of the speakers 100-300 in line with the discussion above. Other examples are possible as well.

In some examples, some components illustrated in FIG. 5 may be distributed across multiple computing devices (e.g., desktop computers, servers, hand-held devices, etc.). However, for the sake of example, the components are shown and described as part of one example device 500.

The device 500 may include an interface 502, a control component 504, data storage 510, and a processor 516. Components illustrated in FIG. 5 may be linked together by a communication link 506. In some examples, the device 500 may include hardware to enable communication within the device 500 and between the device 500 and another computing device (not shown), such as a speaker or a manufacturing platform. The hardware may include transmitters, receivers, and antennas, for example.

The interface 502 may be configured to allow the device 500 to communicate with another computing device (not shown), such as a speaker. Thus, the interface 502 may be configured to receive input data from one or more devices, and may also be configured to send output data to the one or more devices. In some examples, the interface 502 may also maintain and manage records of data received and sent by the device 500. In other examples, records of data may be maintained and managed by other components of the device 500. The interface 502 may also include a receiver and transmitter to receive and send data. In some examples, the interface 502 may also include a user-interface, such as a keyboard, microphone, touch screen, etc., to receive inputs as well. Further, in some examples, the interface 502 may also include interface with output devices such as a display, etc.

The control component 504 may be a hardware interface that is configured to facilitate output of control signals for various devices and apparatuses of the present disclosure, or any other devices. In one example, the control component 504 may include circuitry that operates the speakers 100-300, circuitry that operates the signal conditioner 110, or a communication interface (e.g., USB, HDMI, etc.) to couple with the signal conditioner 110. Other examples are also possible such as wireless communication interfaces (e.g., Wi-Fi, Bluetooth, etc.). In another example, the control component 504 may include a hardware/software interface that is used for fabrication of layers of a membrane (e.g., to control a chemical vapor deposition process, etching, cutting, etc.). In yet another example, the control component 504 may be coupled to a robotic arm that performs physical processes described herein such as depositing a film on a membrane or shaping the film among other possibilities.

The processor 516 may be configured to operate the device 500. For example, the processor 516 may be configured to cause the device 500 to provide instructions to the control component 504 to operate and/or form the membrane or film of a speaker. Further, the processor 516 may also be configured to operate other components of the device 500 such as input/output components or communication components. The device 500 is illustrated to include an additional processor 518. The processor 518 may be configured to control some of the aspects described for the processor 516. For example, the processor 516 may be a controller that operates the control component 604, and the processor 518 may be configured to control other aspects such as the interface 502. Some embodiments may include only one processor (e.g., processor 516) or may include additional processors configured to control various aspects of the device 500.

The data storage 510 may store program logic 512 that can be accessed and executed by the processor 516 and/or the processor 518. For example, the program logic 512 may include instructions for any of the functions described in the method 400.

The communication link 506 is illustrated as a wired connection; however, wireless connections may also be used. For example, the communication link 506 may be a wired serial bus such as a universal serial bus or a parallel bus, or a wireless connection using, e.g., short-range wireless radio technology, communication protocols described in IEEE 802.11 (including any IEEE 802.11 revisions), or cellular wireless technology, among other possibilities.

Figure 6:
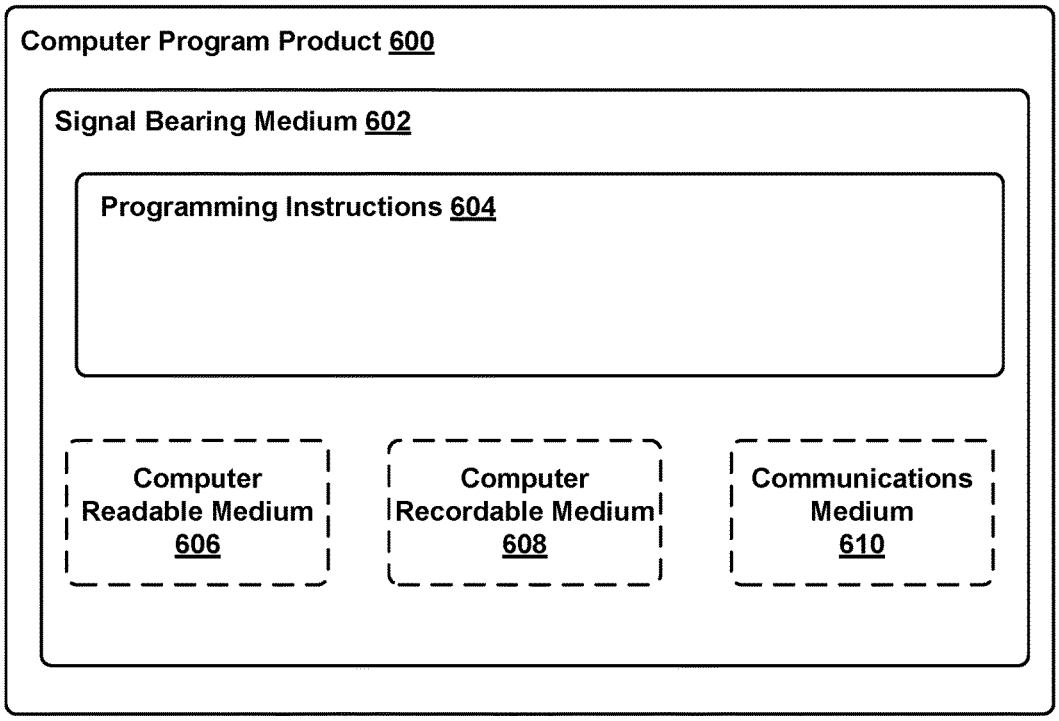
FIG. 6 depicts an example computer readable medium configured according to an example embodiment.

FIG. 6 depicts an example computer readable medium configured according to an example embodiment. In example embodiments, an example system may include one or more processors, one or more forms of memory, one or more input devices/interfaces, one or more output devices/interfaces, and machine readable instructions that when executed by the one or more processors cause the system to carry out the various functions tasks, capabilities, etc., described above.

As noted above, in some embodiments, the disclosed techniques (e.g., method 400) may be implemented by computer program instructions encoded on a computer readable storage media in a machine-readable format, or on other media or articles of manufacture (e.g., program logic 512 of the device 400). FIG. 6 is a schematic illustrating a conceptual partial view of an example computer program product that includes a computer program for executing a computer process on a computing device, arranged according to at least some embodiments disclosed herein.

In one embodiment, the example computer program product 600 is provided using a signal bearing medium 602. The signal bearing medium 602 may include one or more programming instructions 604 that, when executed by one or more processors may provide functionality or portions of the functionality described above with respect to FIGS. 1-5. In some examples, the signal bearing medium 602 may be a computer-readable medium 606, such as, but not limited to, a hard disk drive, a Compact Disc (CD), a Digital Video Disk (DVD), a digital tape, memory, etc. In some implementations, the signal bearing medium 602 may be a computer recordable medium 608, such as, but not limited to, memory, read/write (R/W) CDs, R/W DVDs, etc. In some implementations, the signal bearing medium 602 may be a communication medium 610 (e.g., a fiber optic cable, a waveguide, a wired communications link, etc.). Thus, for example, the signal bearing medium 602 may be conveyed by a wireless form of the communications medium 610.

The one or more programming instructions 604 may be, for example, computer executable and/or logic implemented instructions. In some examples, a computing device may be configured to provide various operations, functions, or actions in response to the programming instructions 604 conveyed to the computing device by one or more of the computer readable medium 606, the computer recordable medium 608, and/or the communications medium 610.

The computer readable medium 606 may also be distributed among multiple data storage elements, which could be remotely located from each other. The computing device that executes some or all of the stored instructions could be an external computer, or a mobile computing platform, such as a smartphone, tablet device, personal computer, wearable device, etc. Alternatively, the computing device that executes some or all of the stored instructions could be remotely located computer system, such as a server.

V. Conclusion

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

I claim:

1. A device comprising:

a membrane that includes one or more layers of an electrically resistive material comprising a boron-nitride sheet;

a film disposed along a surface of the membrane to form a coil, wherein the film includes one or more layers of an electrically conductive material;

a support structure coupled to a periphery of the membrane;

a magnet arranged to provide a magnetic field that is substantially parallel to the surface of the membrane; and a signal conditioner to provide an electrical signal to the coil to generate an electrical current flowing through the coil, wherein the electrical current interacts with the magnetic field to cause a vibration of the membrane, and wherein characteristics of the vibration are based on at least the electrical signal provided by the signal conditioner.

2. The device of claim 1, wherein the generated electrical current is an alternating current based on the electrical signal provided by the signal conditioner, and wherein the characteristics of the vibration are based on Lorentz forces related to the interaction between the magnetic field and the alternating current.

3. The device of claim 1, wherein the characteristics of the vibration are also based on mechanical characteristics of the membrane and mechanical characteristics of the support structure.

4. The device of claim 1, wherein the boron-nitride sheet is a monolayer boron-nitride sheet.

5. The device of claim 1, further comprising:

one or more leads configured to electrically couple the signal conditioner to the film, wherein the signal conditioner is configured to provide the electrical signal via the one or more leads.

6. The device of claim 5, wherein the one or more leads are formed from the same electrically conductive material as the film, wherein the one or more leads are disposed along the surface of the membrane to couple the film to the periphery of the membrane, and wherein the signal conditioner is configured to electrically couple with the one or more leads at the periphery of the membrane.

7. The device of claim 1, further comprising:

a wire coil arranged proximal to the film, wherein the signal conditioner is electrically coupled to the wire coil, and wherein the signal conditioner is configured to provide the electrical signal to the film via inductive coupling by energizing the wire coil.

8. The device of claim 1, wherein the membrane has a thickness less than 50 nanometers.

9. The device of claim 1, wherein the film is shaped as the coil based on etching the electrically conductive material disposed on the surface of the membrane.

10. The device of claim 1, wherein the film is disposed to have a shape of one or more loops of the coil.

11. The device of claim 1, wherein the membrane has a substantially circular shape.

12. The device of claim 1, wherein the signal conditioner is configured to adjust the first magnetic field of the magnet to modify the characteristics of the vibration of the membrane.

13. The device of claim 1, wherein the electrically conductive material of the film comprises a graphene sheet.

14. A device comprising:

a membrane that includes one or more layers of an electrically resistive material;

a film disposed along a surface of the membrane to form a coil, wherein the film includes one or more layers of an electrically conductive material comprising a graphene sheet;

a support structure coupled to a periphery of the membrane;

a magnet arranged to provide a magnetic field that is substantially parallel to the surface of the membrane; and a signal conditioner to provide an electrical signal to the coil to generate an electrical current flowing through the coil, wherein the electrical current interacts with the magnetic field to cause a vibration of the membrane, and wherein characteristics of the vibration are based on at least the electrical signal provided by the signal conditioner.

15. An electromagnetic speaker device comprising:

a diaphragm that includes a monolayer of an electrically resistive material comprising a boron-nitride sheet;

a voice coil that includes a monolayer of an electrically conductive material that is patterned along a surface of the diaphragm;

a magnet arranged to provide a magnetic field that is substantially parallel to the surface of the diaphragm; and a signal conditioner to provide an electrical signal to the voice coil to generate an electrical current flowing through the voice coil, wherein the electrical current interacts with the magnetic field to cause a vibration of the diaphragm, and wherein characteristics of the vibration are based on at least the electrical signal provided by the signal conditioner.

16. The device of claim 15, wherein the magnet is an electromagnet, wherein the signal conditioner is configured to provide another electrical signal to the magnet to adjust the first magnetic field of the magnet, and wherein the characteristics of the vibration are based also on the other electrical signal.

17. The electromagnetic speaker device of claim 15, wherein the electrically conductive material of the film comprises a graphene sheet.

18. An electromagnetic speaker device comprising:

a diaphragm that includes a monolayer of an electrically resistive;

a voice coil that includes a monolayer comprising a graphene sheet patterned along a surface of the diaphragm;

a magnet arranged to provide a magnetic field that is substantially parallel to the surface of the diaphragm; and a signal conditioner to provide an electrical signal to the voice coil to generate an electrical current flowing through the voice coil, wherein the electrical current interacts with the magnetic field to cause a vibration of the diaphragm, and wherein characteristics of the vibration are based on at least the electrical signal provided by the signal conditioner.

* * * * *